United States Patent [19]

Harvey

[11] 4,277,025

[45] Jul. 7, 1981

[54] VIBRATORY ATOMIZER

[75] Inventor: Dennis Harvey, Tilbury, England

[73] Assignee: Plessey Handel und Investments AG, Zug, Switzerland

[21] Appl. No.: 50,604

[22] Filed: Jun. 21, 1979

[30] Foreign Application Priority Data

Jun. 29, 1978 [GB] United Kingdom ..... 28332/78

[51] Int. Cl.[3] ..... B05B 3/14

[52] U.S. Cl. ..... 239/102

[58] Field of Search ..... 239/102, 4; 123/119 EE; 310/311, 316, 317, 323, 348, 351

[56] References Cited

U.S. PATENT DOCUMENTS

| | | | |
|---|---|---|---|
| 3,155,141 | 11/1964 | Doyle et al. | 239/102 |
| 3,178,115 | 4/1965 | Drayer | 239/102 |
| 3,819,116 | 6/1974 | Goodinge et al. | 239/102 |
| 4,000,852 | 1/1977 | Martin | 239/102 |
| 4,003,518 | 1/1977 | Hori et al. | 239/102 |

FOREIGN PATENT DOCUMENTS

| | | | |
|---|---|---|---|
| 2734818 | 2/1978 | Fed. Rep. of Germany | 239/102 |

*Primary Examiner*—Johnny D. Cherry
*Attorney, Agent, or Firm*—Fleit & Jacobson

[57] ABSTRACT

A vibratory atomizer for atomizing a liquid, which atomizer comprises a nozzle portion from which the liquid is ejected, a body portion having vibration means, and a liquid inlet pipe which is attached to the body portion and which is made a number of half wave lengths long for the speed of sound in the pipe whereby in use of the vibratory atomizer energy radiated into the pipe reflects back into the body portion in phase.

9 Claims, 2 Drawing Figures

VIBRATORY ATOMIZER

This invention relates to a vibratory atomiser for atomising a liquid such, for example, as liquid fuel for an engine or a heat exchange boiler.

It is difficult in practice to determine accurately the vibration node of a vibratory atomiser. The vibration node is required to be determined so that the atomiser may be rigidly secured in the region of the vibration node to an associated mounting. Because there is virtually no vibration at the vibration node, little or no energy is thus lost from the atomiser into the mounting during periods when the atomiser is being vibrated.

Hitherto, it has been customary only to take into account vibrations in the longitudinal direction of the atomiser. Radial vibrations and radial movement due to Poissons ratio effect have hitherto usually been neglected. This has mainly been because it is virtually impossible to find a plane of zero vibrations in both the longitudinal and tranverse planes. Since the radial vibrations and radial movements are neglected, energy loss from the atomiser to its mounting occurs.

We have recently made attempts to take into account the radial vibrations and radial movement in mounting the vibratory atomisers and the present invention is based on the further realisation that further energy loss from the atomiser occurs along the liquid inlet pipe for supplying the liquid to the vibratory atomiser.

It is an aim of the present invention to minimise or reduce the energy loss from the atomiser to its liquid inlet pipe during periods when the atomiser is being vibrated.

Accordingly, this invention provides a vibratory atomiser for atomising a liquid, which atomiser comprises a nozzle portion from which the liquid is ejected, a body portion having vibration means, and a liquid inlet pipe which is attached to the body portion and which is made a number of half wave lengths long for the speed of sound in the pipe whereby in use of the vibratory atomiser energy radiated into the pipe reflects back into the body portion in phase.

Usually, a flexible liquid inlet tube will be clamped to the pipe. This tube may be, for example, a rubber or a plastics tube.

Preferably, the pipe is constructed to be one wave length long. In this case, the tube may then be clamped to the pipe by a clamp positioned at a quarter or three quarters of a wave length from the point of attachment of the pipe to the body portion.

In another embodiment of the invention in which the pipe is one wave length long, the pipe is secured to a mounting device, e.g. an engine manifold, by an O-ring positioned at a quarter or three quarters of a wave length from the point of attachment of the pipe to the body portion. Advantageously, the O-ring is a rubber O-ring.

Usually, the vibratory means will be a piezoelectric crystal device but it is to be appreciated that other vibratory devices such, for example, as an electro magnetic device can be employed.

The atomiser is preferably such that it has a ball valve obturator which is effective to prevent injection of the liquid from the atomiser when the body portion is not being vibrated.

The vibratory atomiser of the present invention may be used to inject fuel into an engine of a vehicle and it may also be used to inject fuel into a heat exchange boiler, for use, for example, in central heating systems.

Usually, the vibratory atomiser will be vibrated with ultra-sonic vibrations. In practice, the lower limit of these ultra-sonic vibrations may be near the upper limit of audibility to the human ear. However, it is desirable that the vibrations will be of such frequency that they cannot normally be heard by the human ear, thereby avoiding undue noise.

Embodiments of the invention will now be described solely by way of example and with reference to the accompanying drawings in which.

Figure 1:
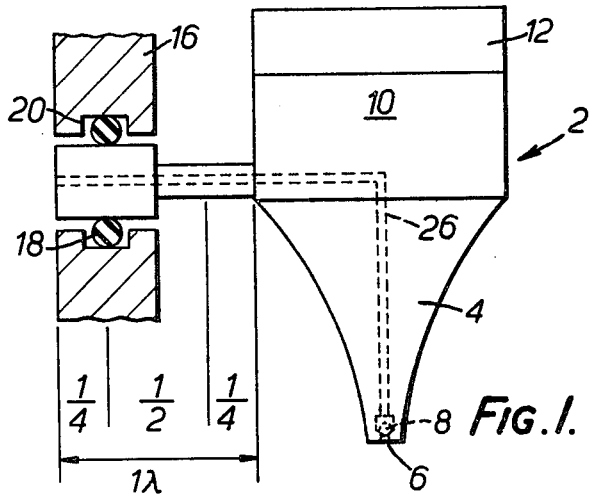
FIG. 1 shows a first embodiment of the invention.

Referring to FIG. 1, there is shown a vibratory atomiser 2 for atomising a liquid. The atomiser 2 comprises a nozzle portion 4 from which the liquid is ejected via an orifice 6 which is normally closed by a non-return ball valve obturator 8. The nozzle portion 4 is joined to an integrally formed body portion 10. The side of the body portion 10 remote from the nozzle portion 4 is provided with vibration means in the form of a piezoelectric crystal 12. This piezoelectric crystal 12 will be provided with an appropriate electrical lead (not shown) for enabling the crystal 12 to be energised when desired.

A metallic liquid inlet pipe 14 is joined to the body portion 10 as shown and this pipe 14 is one wave length long. The pipe 14 is joined to a fuel manifold 16 of an engine (not shown) by means of a rubber O-ring 18 which seats in an annular groove 20 in the manifold 16. The O-ring 18 is located at three quarters of a wave length from the point of attachment of the pipe 14 to the body portion 10.

Figure 2:
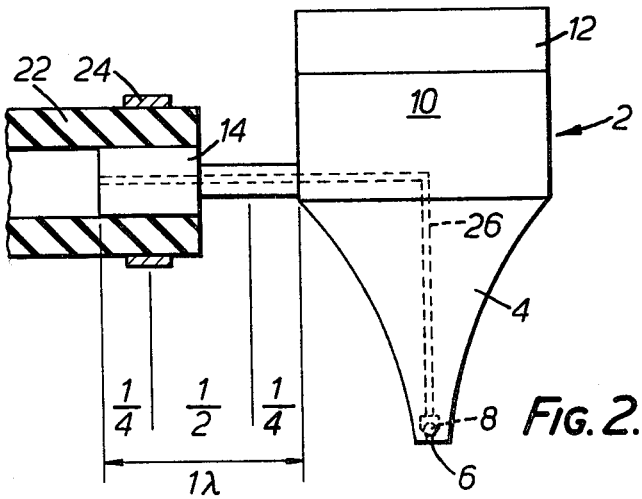
FIG. 2 shows a second embodiment of the invention.

Referring now to FIG. 2, similar parts as in FIG. 1 have been given the same reference numeral and their precise construction and operation will not again be given in order to avoid undue repetition of description. In FIG. 2, a rubber hose 22 is attached to the pipe 14 by means of a pipe clamp 24. The clamp 24 is, as shown, positioned at three quarters of a wave length from the point of attachment of the pipe 14 to the body portion 10.

In use of the vibratory atomisers illustrated in FIGS. 1 and 2, electrical energisation of the crystals 12 causes the devices to vibrate and the ball valve obturator 8 to be shaken off its seat so that fuel can pass from the pipe 14, along a fuel line 26 in each of the atomisers 2 and out through their orifices 6.

It is to be appreciated that the embodiments of the invention described above have been given by way of example only and that modifications may be effected. Thus, for example, the O-ring 18 and the clamp 24 could be positioned at one quarter wave length from the point of attachment of the pipe 14 to the body portion 10. Also, if desired, the vibratory atomiser 2 could be employed for injecting liquids other than fuel into devices other than engines and boilers. Thus, the vibratory atomiser could be used to inject liquids such for example as chemicals and paint. Also, if desired, the ball valve obturator 6 could be dispensed with, in which case the vibratory atomisers 2 would inject a solid jet of liquid (which could be collected and re-cycled if desired) until such time as the piezoelectric crystal 12 is energised to cause the vibratory atomiser 2 and especially its tip to vibrate and atomise the jet of liquid.

We claim:

1. A vibratory atomizer for atomizing a liquid, which atomizer comprises a nozzle portion from which the liquid is ejected, a body portion having a longitudinal direction and a radial direction, means for vibrating said body portion in said longitudinal direction with a specified longitudinal vibration frequency and wavelength causing radial vibrations to be transmitted, and a liquid inlet pipe attached to the body portion at a nodal plane of the longitudinal vibrations and extending in said radial direction from the body portion by a length equal to an integral number of vibration half wavelengths which causes the pipe to resonate when it receives any of said radial vibrations generated by said means for vibrating said body portion, wherein, in use, energy passing into the pipe from said body portion reflects back into the body portion in phase with the vibrations thereof.

2. A vibratory atomizer according to claim 1 in which a flexible liquid inlet tube is clamped to the pipe.

3. A vibratory atomizer according to claim 2 in which the pipe is constructed to extend one vibration wavelength from the body portion, and in which the flexible liquid inlet tube is clamped to the pipe by a clamp positioned at a quarter of a wavelength from the point of attachment of the pipe to the body portion.

4. A vibratory atomizer according to claim 2 in which the pipe is constructed to extend one vibration wavelength from the body portion, and in which the flexible liquid inlet tube is clamped to the pipe by a clamp positioned at three quarters of a wavelength from the point of attachment of the pipe to the body portion.

5. A vibratory atomizer according to claim 2 in which the pipe is constructed to extend one vibration wavelength from the body portion, and in which the pipe is secured to a mounting device by an O-ring positioned at a quarter of a wavelength from the point of attachment of the pipe to the body portion.

6. A vibratory atomizer according to claim 2 in which the pipe is constructed to extend one vibration wavelength from the body portion, and in which the pipe is secured to a mounting device by an O-ring positioned at three quarters of a wavelength from the point of attachment of the pipe to the body portion.

7. A vibratory atomizer according to claim 2 in which the vibratory means is a piezoelectric crystal device.

8. A vibratory atomizer according to claim 7 comprising a ball valve obturator which is effective to prevent injection of the liquid from the atomiser when the body portion is not being vibrated.

9. In a vibratory atomizer for atomizing a liquid, which atomizer comprises a nozzle portion from which the liquid is ejected, a body portion having a longitudinal direction and a radial direction, means for vibrating said body portion in said longitudinal direction with a specified longitudinal vibration frequency and wavelength causing radial vibrations to be transmitted, and a liquid inlet pipe attached to the body portion at a nodal plane of the longitudinal vibrations, the improvement wherein said liquid inlet pipe extends in said radial direction from the body portion by a length equal to an integral number of vibration half wavelengths so as to cause the pipe to resonate when it receives any of said radial vibrations generated by said means for vibrating said body portion, wherein, in use, energy passing into the pipe from said body portion reflects into the body portion in phase with the vibrations thereof.

* * * * *